US009599103B2

(12) United States Patent
Galtz

(10) Patent No.: US 9,599,103 B2
(45) Date of Patent: Mar. 21, 2017

(54) METHOD FOR OPERATING A DOSING PUMP AND DEVICE HAVING A DOSING PUMP

(75) Inventor: Gunter Galtz, Straβlach-Dingharting (DE)

(73) Assignee: WEBASTO SE, Stockdorf (DE)

( * ) Notice: Subject to any disclaimer, the term of this patent is extended or adjusted under 35 U.S.C. 154(b) by 731 days.

(21) Appl. No.: 13/637,680

(22) PCT Filed: Feb. 24, 2011

(86) PCT No.: PCT/EP2011/052730

§ 371 (c)(1),
(2), (4) Date: Nov. 19, 2012

(87) PCT Pub. No.: WO2011/124413

PCT Pub. Date: Oct. 13, 2011

(65) Prior Publication Data

US 2013/0064686 A1 Mar. 14, 2013

(30) Foreign Application Priority Data

Apr. 7, 2010 (DE) ..... 10 2010 014 106

(51) Int. Cl.
*F04B 35/04* (2006.01)
*F04B 49/06* (2006.01)
*F04B 17/03* (2006.01)

(52) U.S. Cl.
CPC ..... *F04B 17/03* (2013.01); *F04B 35/045* (2013.01); *F04B 49/06* (2013.01); *F04B 49/065* (2013.01);
(Continued)

(58) Field of Classification Search
CPC ..... F04B 35/045; F04B 49/065; F04B 2203/0402
(Continued)

(56) References Cited

U.S. PATENT DOCUMENTS 5,752,385 A * 5/1998 Nelson ..... 62/6
7,184,254 B2 * 2/2007 Dimanstein ..... 361/187
(Continued)

FOREIGN PATENT DOCUMENTS

CN 1299294 A 6/2001
CN 2908859 Y 6/2007
(Continued)

OTHER PUBLICATIONS (International Preliminary Report for PCT/EP2011/052730).

*Primary Examiner* — Peter J Bertheaud
(74) *Attorney, Agent, or Firm* — Fitch, Even, Tabin & Flannery LLP

(57) ABSTRACT

A method for operating a vehicle heater dosing pump for conveying fuel having a piston which can be moved back and forth between a start position and an end position, and a drive unit which can be electrically excited by applying a voltage, having the following procedure: controlling and/or regulating the voltage for generating an effective voltage to transfer the piston from the start position to the end position, wherein the effective voltage reaches a first maximum ($U_1$) in a start phase ($t_0$-$t_1$), and is lower than the first maximum in a subsequent intermediate phase ($t_1$-$t_2$). The effective voltage reaches a second maximum ($U_3$) in an end phase ($t_2$-$t_3$) following the intermediate phase. A device is also provided having a dosing pump and a control/regulation unit. The control/regulation unit is suitable for controlling voltage applied to a drive unit of the dosing pump.

11 Claims, 4 Drawing Sheets

(52) U.S. Cl.
CPC ..... *F04B 2201/0204* (2013.01); *F04B 2203/0402* (2013.01)

(58) Field of Classification Search
USPC ..... 417/44.1, 45
See application file for complete search history.

(56) References Cited

U.S. PATENT DOCUMENTS

| | | | | |
|---|---|---|---|---|
| 7,663,275 | B2 * | 2/2010 | McGill et al. | 310/68 R |
| 2002/0061255 | A1 | 5/2002 | Nguyen et al. | |
| 2003/0192919 | A1 | 10/2003 | Nguyen et al. | |
| 2007/0025861 | A1 * | 2/2007 | Yaguchi et al. | 417/44.1 |

FOREIGN PATENT DOCUMENTS

| | | | |
|---|---|---|---|
| DE | 29821022 | U1 | 7/1999 |
| DE | 10152782 | A1 | 5/2003 |
| DE | 10 2004 002454 | A1 | 8/2005 |
| DE | 102005024858 | A1 | 12/2006 |
| DE | 60036720 | T2 | 7/2008 |
| DE | 10 2007 021759 | A1 | 12/2008 |
| DE | 102007061478 | A1 | 6/2009 |
| DE | 102009019450 | A1 | 11/2010 |

* cited by examiner

METHOD FOR OPERATING A DOSING PUMP AND DEVICE HAVING A DOSING PUMP

CROSS-REFERENCE TO RELATED APPLICATIONS

This application is a U.S. National Stage filing under 35 U.S.C. 371 of International Application No. PCT/EP2011/052730, filed Feb. 24, 2011, designating the United States and claims the benefit of foreign priority from German Patent Application Number 10 2010 014106.2, filed Apr. 7, 2010, the entire disclosures of which are incorporated herein by reference.

The invention relates to a method for operating a dosing pump, in particular for delivering fuel for a vehicle heating unit, wherein the dosing pump comprises a piston, which for delivery is movable back and forth between a starting position and an end position, and a drive unit which can be electrically excited by the application of a voltage, having the following measure:

controlling and/or regulating the voltage so as to generate an effective voltage in order to move the piston from the starting position into the end position, wherein the effective voltage assumes a first maximum in a starting phase and is lower than the first maximum in a subsequent intermediate phase.

The invention also relates to a device for carrying out the method.

A method of said type is known from DE 10 2005 024 858 A1. The amplitude of the voltage applied to the drive unit determines the magnitude of a drive force acting on the piston which can move back and forth, and thus the speed of the piston. The voltage may be pulse-width-modulated. In this case, the present amplitude of the applied voltage does not directly influence the speed of the piston, but rather a mean value of the voltage with respect to time determines an effective voltage which in turn determines the force acting on the piston. The effective voltage is determined from the present voltage by averaging over a time interval which is long in relation to modulation-induced fluctuations of the voltage but which is short in relation to a period duration of the movement of the piston.

To set the piston in motion proceeding from the starting position, and move it into the end position, in an improved manner, DE 10 2005 024 858 A1 provides that, during an excitation time interval, the effective voltage is not constant but rather varies, that is to say assumes at least two different effective voltage values. In this way, it can be achieved firstly that the piston begins to move as quickly as possible at the start of the excitation time interval. It can be achieved secondly that the piston reaches its end position at not too high a speed. In this way, an audible and possibly disturbing impact noise can be prevented or at least reduced.

DE 10 2007 061 478 A1 describes the determination of a fault state of a dosing pump in which the piston does not reach its end stop. It is sought to realize a faster movement of the piston, or indeed any movement of the piston at all, by increasing a mean applied voltage.

DE 600 36 720 T2 describes a dosing pump which is capable of detecting a highly viscous fluid state automatically, specifically by sensing the position and speed of an armature, and increasing an amount of energy applied in order to successfully complete a stroke of the pump in the presence of said fluid state.

A dosing pump is generally optimized for certain operating conditions. The operating conditions are to be understood to include parameters such as for example the ambient temperature, the viscosity of the liquid to be delivered, and the counterpressure acting on the piston. The operating conditions may vary over time. Both the electrical resistance of the drive unit and also the viscosity of the liquid to be delivered are generally temperature-dependent. The drive unit typically comprises a coil for generating a magnetic field, and the resistance of the coil increases with rising temperature. Here, the increase in electrical resistance is typically of greater significance than the decrease in viscosity of the liquid to be delivered, such that at elevated temperature, a voltage which must be applied to the drive unit tends toward higher values. A counterpressure (outlet pressure) acting on the piston arises if the outlet of the dosing pump is connected to a pressurized reservoir or to a pressurized line.

It is the object of the invention to specify a method for operating a dosing pump, which method is to the greatest possible extent tolerant of temperature changes and/or changes in viscosity of the liquid to be delivered and/or changes of a counterpressure acting on the piston.

Said object is achieved by means of the features of the independent claims.

Advantageous embodiments emerge from the dependent claims.

The method according to the invention builds on the generic prior art in that the effective voltage reaches a second maximum in an end phase which follows the intermediate phase. The profile of the effective voltage during the starting phase and the intermediate phase may be configured such that, under normal conditions, the piston just reaches its end position, or when it reaches its end position is moving at an end speed which is low in relation to its maximum speed. The end phase is a phase which is later than the intermediate phase. The end phase may in particular follow the intermediate phase. In the end phase, an effective voltage is generated which is elevated in relation to the intermediate phase. Under normal conditions, for example at normal temperature (for example 15° C.) and/or normal (for example low) viscosity of the delivered liquid and/or normal (for example low) outlet pressure, the application of the voltage in the end phase has the result that the piston remains in its end position for slightly longer before returning into its starting position. By contrast, in the presence of an adequately high temperature, an adequately high viscosity or an adequately high outlet pressure, the piston would not reach its end position without an additional supply of energy. In this case, the second maximum of the effective voltage which occurs in the end phase ensures that the piston reaches its end position. The proposed method is thus suitable in particular for use at variable ambient temperatures, for delivering a liquid whose viscosity is variable, for delivering different liquids of different viscosity, and for delivering against a variable outlet pressure. At normal temperature, normal viscosity of the liquid to be delivered and normal outlet pressure, the increased effective voltage during the end phase does not lead to a louder impact noise of the piston or at most leads to a slightly louder impact noise, because in this case the piston reaches its end position already in the intermediate phase.

It may be provided that the second maximum is lower than the first maximum. This makes allowance for the fact that, in many applications which are encountered in practice, it can be assumed that, even at the highest temperature to be expected, the piston has already covered more than half of its stroke at the end of the intermediate phase, such that the acceleration which takes place in the end phase may be lower than the acceleration in the starting phase.

During the starting phase and/or the intermediate phase and/or the end phase, the effective voltage may for example be in each case constant or defined by a step function. The generation of such an effective voltage is technically particularly simple.

In one preferred embodiment, the effective voltage is zero during the intermediate phase. An impact noise of the piston when it reaches the end position can be minimized in this way.

It may be provided that the piston reaches its end position during the intermediate phase. This situation may arise for example when the dosing pump is being operated under normal conditions.

It may likewise be provided that the piston reaches its end position during the end phase. This situation may arise for example in the presence of elevated ambient temperature.

In a preferred embodiment, the voltage is controlled/regulated independently of the movement of the piston. An effective voltage profile, once determined, can thus be used for a plurality of cycles of the pump process. A determination of the intended effective voltage profile during normal pump operation can be dispensed with. In particular, for the control and/or regulation of the voltage, there is no need for determining the position of the piston, or evaluating information regarding the present position of the piston, during the control/regulation. The time during the excitation time interval at which the piston has reached the position at or close to the end position also need not be determined.

It may be provided that the voltage is at least intermittently pulse-width-modulated. This may be realized through control and/or regulation of a duty cycle. As an alternative to pulse-width modulation, the voltage could for example also be controlled/regulated so as to be as identical as possible to the intended effective voltage at all times.

It may be provided that a control/regulating unit accesses stored items of information which define the effective voltage profile, and controls/regulates the voltage on the basis of said items of information. The items of information may for example be stored in the form of a digital list or table, for example on an electronic, optical or magnetic memory or data carrier. The list or table may assign to a set of time points a corresponding set of intended values of the effective voltage. Alternatively, the list or table may assign voltage values to a set of time points, in such a way that the corresponding voltage profile yields the intended effective voltage profile. Alternatively, the list or table may assign to a set of time points a corresponding set of duty cycles.

In this connection, it may be provided that the control/regulating unit does not use any information from which it is possible to infer an actual position or speed of the piston. A particularly inexpensive and robust method is provided in this way.

It may be provided that a restoring force causes a return of the piston into the starting position. The restoring force is to be understood to mean a force which acts in the direction of a rest position of the piston when the piston is deflected out of the rest position. The rest position may be identical to the starting position of the piston. The restoring force may be generated for example by a spring which is arranged so as to be elastically deformed during a movement of the piston from the starting position to the end position. It may be provided that the voltage is adjusted by control/regulation to zero during an off period. In this connection, it may be provided that the length of the off period is controlled/regulated during the execution of the method so as to control the delivery rate of the dosing pump.

The device according to the invention comprises a dosing pump of the type described in the introduction and also a control/regulating unit suitable for carrying out the following measure: controlling and/or regulating the voltage so as to generate an effective voltage in order to move the piston from the starting position into the end position, wherein the effective voltage assumes a first maximum in a starting phase and is lower than the first maximum in a subsequent intermediate phase, wherein the effective voltage reaches a second maximum in an end phase which follows the intermediate phase. The advantages discussed in conjunction with the method according to the invention emerge analogously for the device according to the invention.

It may be provided that the control/regulating unit comprises a memory and a processor and a profile of the effective voltage is at least partially defined by items of information which are present in the memory and which can be read by the processor. The items of information may for example comprise a digital list/table which explicitly or implicitly in each case assigns to at least two time points a corresponding effective voltage value. The memory may be for example an electronic, optical or magnetic memory or data carrier, for example a read-only memory (ROM).

In one preferred embodiment, under normal conditions, the piston reaches its end position during the intermediate phase. This may be achieved through corresponding tuning of the effective voltage profile, for example through the selection of the respective length of the starting phase, of the intermediate phase and of the end phase and of the level of the effective voltage during said phases.

It is also preferable if, at elevated temperature and/or when the dosing pump is delivering a highly viscous liquid, the piston reaches its end position during the end phase. This, too, may be achieved through corresponding tuning or programming of the effective voltage profile.

The invention will now be explained on the basis of exemplary embodiments and with reference to the appended drawings. Here, identical or similar components are denoted by the same reference numerals.

Figure 1:
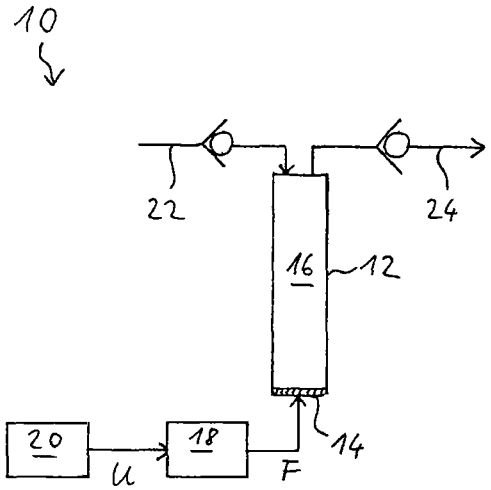
Fig. 1 Prior Art
FIG. 1 shows a dosing pump at a first time during a pump cycle.

FIG. 1 schematically shows an example of a device 10 for pumping a liquid, for example a fuel, from an inlet line 22 to an outlet line 24 by means of a dosing pump 12. The dosing pump 12 comprises a housing and a piston 14 which, together with the housing, defines a pump chamber 16. The present position of the piston 14 relative to the housing defines a present volume of the pump chamber 16. FIG. 1 shows the piston 14 in a starting position, in which the pump chamber 16 assumes its maximum volume.

Figure 2:
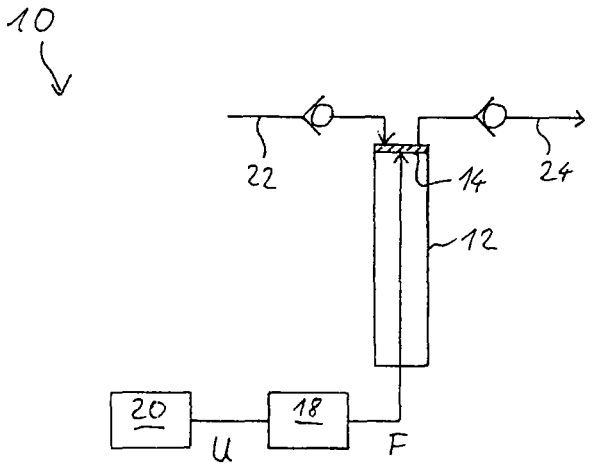
Fig. 2 Prior Art
FIG. 2 shows the dosing pump at a second time during the pump cycle.

FIG. 2 shows the piston 14 in an end position in which the volume of the pump chamber 16 is zero. The piston 14 is connected to an electric drive unit 18. The drive unit 18 is suitable for cyclically or periodically exerting a force F on the piston 14 in order to move the piston 14 back and forth between its starting position and its end position. The dosing pump 12 may have a spring (not illustrated) which causes a return of the piston 14 from the end position into the starting position without the drive unit 18 having to exert a force for this purpose. The drive unit 18 has a coil to which an electrical voltage U can be applied in order to generate a current and thus the force F. The voltage U which is applied to the coil is controlled/regulated by a control/regulating unit 20. The voltage U may be amplitude-modulated. It may alternatively be pulse-width-modulated.

Figure 3:
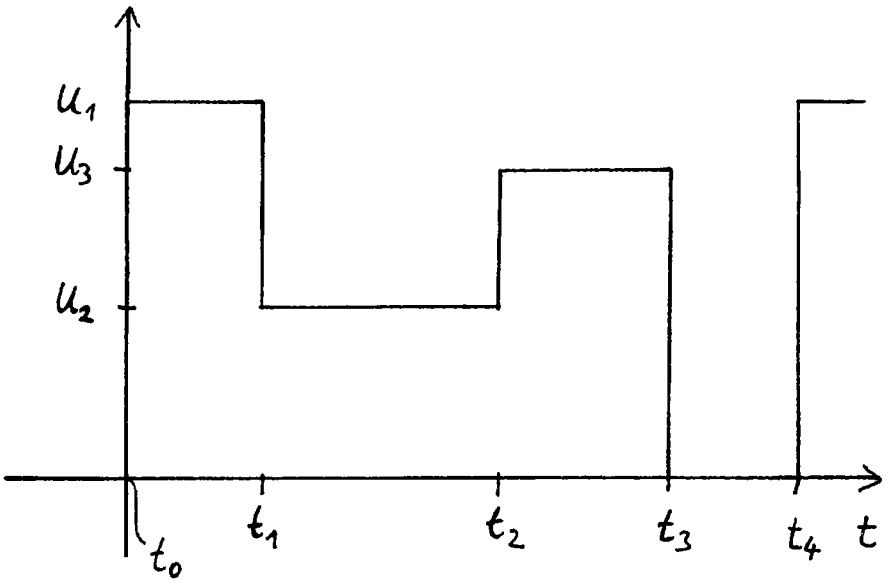
FIG. 3 shows the profile of an effective voltage.

FIG. 3 illustrates by way of an example the time profile of an effective voltage $U_{eff}$ which corresponds to the voltage U applied to the coil of the drive unit 18. The effective voltage is periodic, with a period duration T. At the time $t_0$, the piston 14 is situated in its starting position. At said time, an effective voltage of magnitude $U_1$ is applied. Said voltage sets the piston 14 in motion in the direction of the end position. At a later time $t_1$, the effective voltage is reduced to a value $U_2$ ($U_2<U_1$). At a later time $t_2$, the effective voltage is increased to a value $U_3$. At a later time $t_3$, the effective voltage is reduced to zero. At the time $t_4$, a new pump cycle begins in which an effective voltage is applied analogously to the effective voltage in the interval [0, $t_4$]. The intervals $t_0$ to $t_1$, $t_1$ to $t_2$, $t_2$ to $t_3$ and $t_3$ to $t_4$ are referred to in each case as the starting phase, intermediate phase, end phase and off phase (off period). For given lengths of said phases and given voltage values $U_1$, $U_2$ and $U_3$, the movement of the piston is dependent on the electrical resistance of the drive unit, on the viscosity of the liquid being delivered and on the outlet pressure. In particular, the electrical resistance and the viscosity may in turn be dependent on the ambient temperature.

Under normal conditions (for example at normal temperature, low or normal viscosity and normal outlet pressure), the piston moves as follows. In the starting phase [$t_0$, $t_1$], the piston is set in motion by the high effective voltage $U_1$. In the subsequent intermediate phase [$t_1$, $t_2$], the piston is braked by friction forces and/or by the outlet pressure, which cannot be fully compensated by the lower voltage $U_2$ which is now applied, and reaches its end position approximately at the time $t_2$, preferably precisely at the time $t_2$. Here, the end speed of the piston, that is to say the speed of the piston when it reaches the end position, is preferably low, if possible zero. The effective voltage pulse of magnitude $U_3$ which is applied in the end phase [$t_2$, $t_3$] which follows acts on the piston only so as to prevent an immediate return of the piston into its starting position. By contrast, said effective voltage pulse does not lead to a louder impact noise, because the piston has already impacted or is already situated close to the stop. During the off period [$t_3$, $t_4$], the piston finally returns into its starting position under the action of a restoring force.

Under adverse operating conditions (for example at elevated temperature, elevated viscosity of the liquid to be delivered or elevated outlet pressure), the piston moves slightly differently. In the starting phase [$t_0$, $t_1$], it is accelerated. Owing to the adverse operating conditions, it has not yet reached its end position at the time $t_2$. Its speed at the time $t_2$ is zero or even negative. As a result of the voltage pulse of magnitude $U_3$ which starts at the time $t_2$, the piston is accelerated again and reaches the end position during the end phase [$t_2$, $t_3$] or possibly first during the off period [$t_3$, $t_4$]. The provision of an elevated effective voltage in the end phase [$t_2$, $t_3$] thus ensures that the piston reaches the predefined end position even under the adverse operating conditions.

Figure 4:
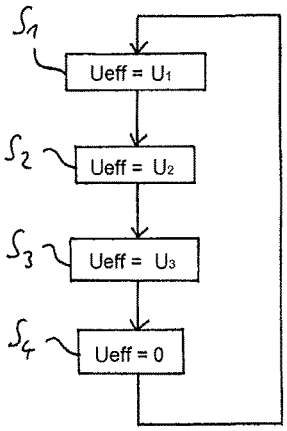
FIG. 4 shows a flow diagram of the operation of a dosing pump.

The flow diagram in FIG. 4 illustrates the activation of the dosing pump 12 in accordance with the effective voltage profile depicted in FIG. 3. At the time $t_0$, an effective voltage of magnitude $U_1$ is applied (step S1). At the subsequent time $t_1$, the effective voltage is reduced to the value $U_2$ (step S2). At the subsequent time $t_2$, the effective voltage is increased to the value $U_3$ (step S3), wherein $U_3$ is lower than $U_1$. At the subsequent time $t_3$, the effective voltage is reduced to zero in order to permit a return of the piston into its starting position (step S4). At the subsequent time $t_4$, the method returns to step S1.

Figure 5:
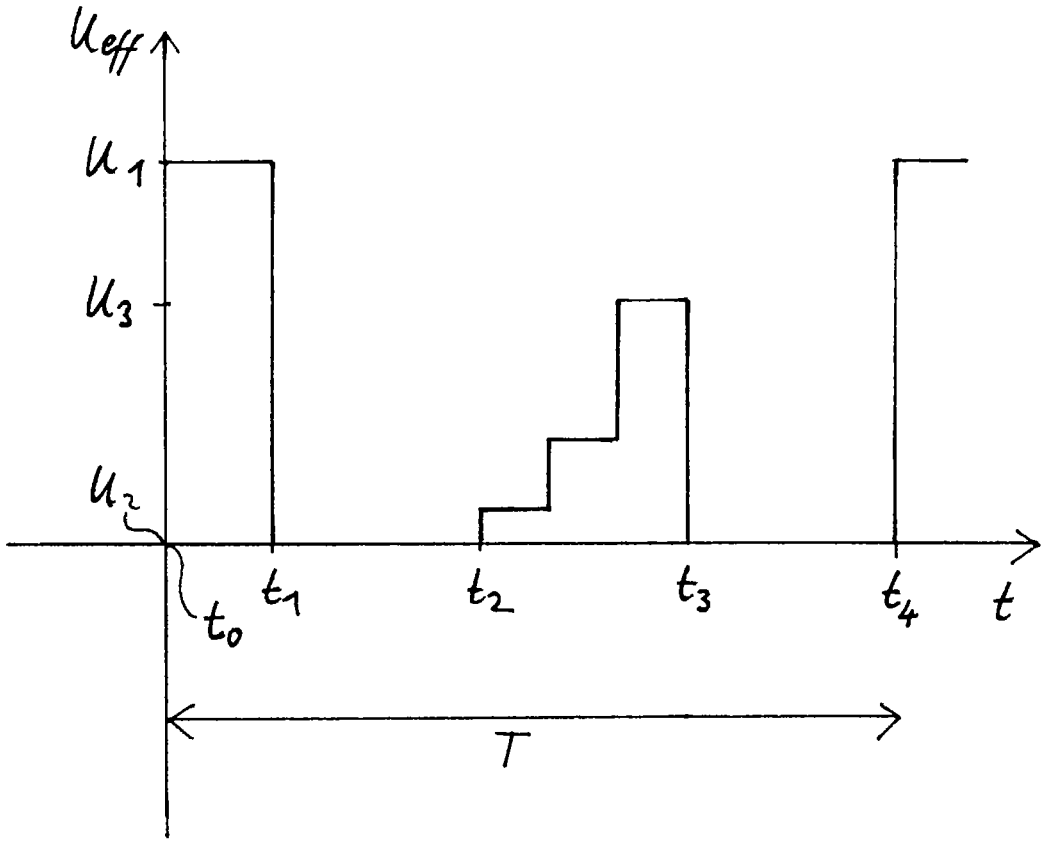
FIG. 5 shows the profile of an effective voltage according to a second embodiment.

FIG. 5 schematically shows the effective voltage profile according to a further embodiment. In the starting phase [$t_0$, $t_1$], the intended effective voltage assumes the constant high value $U_1$. In the subsequent intermediate phase [$t_1$, $t_2$], the effective voltage is zero. In the end phase [$t_2$, $t_3$] which follows, the effective voltage is characterized by a rising step function. In this way, the dosing pump is optimized for different operating conditions. The three different voltage levels during the end phase [$t_2$, $t_3$] may for example be assigned to three different temperature values or viscosity values. Here, the highest and latest voltage level in the end phase [$t_2$, $t_3$] has an advantageous effect in the presence of the highest temperature or viscosity. A different number of voltage levels during the end phase [$t_2$, $t_3$] is self-evidently also conceivable. For example, the effective voltage could be defined, during the end phase, by a step function and in particular by a rising step function with two, three, four or five steps. Embodiments may also be realized in which, by contrast to FIG. 3 and FIG. 5, the effective voltage is not constant in portions but rather varies continuously.

REFERENCE SYMBOLS

10 Device
12 Dosing pump
14 Piston
16 Pump chamber
18 Drive unit
20 Control/regulating unit
22 Inlet line
24 Outlet line
U Voltage
Ueff Effective voltage
t Time

The invention claimed is:

1. A method for operating a dosing pump, wherein the dosing pump comprises a piston, which for delivery is movable back and forth between a starting position and an end position, and a drive unit which can be electrically excited by the application of a voltage, the method having the step of:

controlling the voltage so as to generate an effective voltage in order to move the piston from the starting position into the end position, that differs from the starting position, wherein the effective voltage assumes a first local maximum ($U_1$) in a starting phase ($t_0$-$t_1$) and is lower than the first local maximum in a subsequent intermediate phase ($t_1$-$t_2$), and wherein the effective voltage assumes a second local maximum ($U_3$), higher than the effective voltage applied during the intermediate phase, in an end phase ($t_2$-$t_3$) which follows the intermediate phase, wherein the piston reaches its end position during the intermediate phase, and wherein the piston stays in its end position during the end phase.

2. The method of claim 1, wherein the second local maximum ($U_3$) is lower than the first local maximum ($U_1$).

3. The method of claim 1 wherein, during the starting phase and/or the intermediate phase and/or the end phase, the effective voltage is in each case constant or defined by a step function.

4. The method of claim 1, wherein the effective voltage is zero during the intermediate phase.

5. The method of claim 1, wherein the voltage is controlled independently of the movement of the piston.

6. The method of claim 1, wherein the voltage is at least intermittently pulse-width-modulated.

7. The method of claim 1, wherein a control unit accesses stored items of information which define a profile of the effective voltage for the starting phase, the intermediate phase and the end phase, and controls the voltage on the basis of said items of information.

8. The method of claim 7, wherein the control unit does not use any information from which it is possible to infer an actual position or speed of the piston.

9. The method of claim 1, wherein a restoring force causes a return of the piston into the starting position.

10. A device comprising:

a dosing pump, wherein the dosing pump comprises a piston, which for delivery is movable back and forth between a starting position and an end position, that differs from the starting position, and a drive unit which can be electrically excited by the application of a voltage, and a control unit suitable for carrying out the following measure:

controlling the voltage so as to generate an effective voltage in order to move the piston from the starting position into the end position, wherein the effective voltage assumes a first local maximum ($U_1$) in a starting phase ($t_0$-$t_1$) and is lower than the first local maximum ($U_1$) in a subsequent intermediate phase ($t_1$-$t_2$), wherein the piston reaches its end position during the intermediate phase and wherein the piston stays in its end position during the end phase, wherein the effective voltage assumes a second local maximum ($U_3$), higher than the effective voltage applied during the intermediate phase, in an end phase ($t_2$-$t_3$) which follows the intermediate phase.

11. The device of claim 10, wherein the control unit comprises a memory and a processor and a profile of the effective voltage is at least partially defined by items of information which are present in the memory and which can be read by the processor.

* * * * *